US008836599B2

(12) United States Patent
Peng et al.

(10) Patent No.: US 8,836,599 B2
(45) Date of Patent: Sep. 16, 2014

(54) MULTI-BAND BROADBAND ANTENNA WITH MAL-POSITION FEED STRUCTURE

(75) Inventors: Chia-Mei Peng, New Taipei (TW); I-Fong Chen, New Taipei (TW); Jin-Hao Liou, Taichung (TW)

(73) Assignee: I-Fong Chen, New Taipei (TW)

( * ) Notice: Subject to any disclaimer, the term of this patent is extended or adjusted under 35 U.S.C. 154(b) by 256 days.

(21) Appl. No.: 13/413,199

(22) Filed: Mar. 6, 2012

(65) Prior Publication Data

US 2013/0234895 A1 Sep. 12, 2013

(51) Int. Cl.

| | |
|---|---|
| ***H01Q 1/38*** | (2006.01) |
| ***H01Q 9/16*** | (2006.01) |
| ***H01Q 5/00*** | (2006.01) |

(52) U.S. Cl.

USPC ..... 343/795; 343/700 MS; 343/829

(58) Field of Classification Search

USPC ..... 343/700 MS, 790, 791, 792, 795, 828, 343/831, 833

See application file for complete search history.

(56) References Cited

U.S. PATENT DOCUMENTS

| | | | | |
|---|---|---|---|---|
| 5,828,340 | A * | 10/1998 | Johnson | 343/700 MS |
| 6,600,454 | B1 * | 7/2003 | Moilanen | 343/795 |
| 2010/0103050 | A1 * | 4/2010 | Shimizu | 343/700 MS |
| 2010/0289702 | A1 * | 11/2010 | Liu et al. | 343/700 MS |
| 2011/0267237 | A1 * | 11/2011 | Wong et al. | 343/702 |
| 2013/0249741 | A1 * | 9/2013 | Chen et al. | 343/700 MS |

* cited by examiner

*Primary Examiner* — Dameon E Levi
*Assistant Examiner* — Harold L Rappaport
(74) *Attorney, Agent, or Firm* — Guice Patents PLLC

(57) ABSTRACT

A multi-band broadband antenna with mal-position feed structure includes a signal line of high-frequency radiation path with a signal feed-in point, and a ground line of low-frequency radiation path with opposing ground feed-in point and top-loading portion. The design exhibits a mal-position feed structure so that a co-planar waveguide structure is formed in the multi-band broadband antenna to increase the antenna's operating bandwidth.

6 Claims, 5 Drawing Sheets

| | H-Plane (xy-plane) | E-Plane (zx-plane) | 3D Pattern |
|---|---|---|---|
| | Max. Gain | Max. Gain | Efficiency (%) |
| 698 | 0.47 | 0.93 | 50.02 |
| 790 | 0.11 | 0.49 | 53.55 |
| 850 | 0.22 | 0.14 | 50.21 |
| 960 | 0.06 | 0.17 | 52.44 |
| 1710 | 0.72 | 0.81 | 59.54 |
| 1800 | 0.93 | 0.53 | 53.27 |
| 1900 | 0.12 | 0.97 | 67.37 |
| 2100 | 1.08 | 1.77 | 68.24 |
| 2700 | 1.05 | 1.69 | 77.22 |
| 5150 | 0.71 | 199 | 71.02 |
| 5850 | 1.03 | 1.87 | 77.43 |

FIG. 5

MULTI-BAND BROADBAND ANTENNA WITH MAL-POSITION FEED STRUCTURE

BACKGROUND OF THE INVENTION

1. Field of the Invention

The present invention relates to antenna technology and more particularly, to a printed circuit board type asymmetrical dipole antenna that effectively broadens the operating bandwidth.

2. Description of the Related Art

A simple mono-pole antenna has an operating bandwidth about 10%, which is relatively narrower when compared to regular international communication standards. Further, a mono-pole antenna usually needs to use the antenna-carrying circuit board or the ground-contact area of the antenna-carrying mechanism as a negative pole for energy radiation, and the radiation pattern is determined subject to the antenna-carrying mechanism. When the size of the antenna-carrying mechanism is greater than ¼ wavelength (λ), the radiation current will undergo a phase change to destructively interfere with magnetic waves in space, leading to communication dead angle.

Further, a conventional dipole antenna or loop antenna commonly has a predetermined size of radiator and a parallel feeding-line structure connected to the radiator for the feeding of signals. The bandwidth utilization of a conventional dipole antenna or loop antenna is simply about 8~12%. Due to narrow operating bandwidth, conventional dipole antennas and loop antennas cannot satisfy the requirements for wireless application.

SUMMARY OF THE INVENTION

The present invention has been accomplished under the circumstances in view. It is main object of the present invention to provide a multi-band broadband antenna with mal-position feed structure, which effectively widens the operating bandwidth.

To achieve this and other objects of the present invention, a multi-band broadband antenna with mal-position feed structure comprises a dipole structure consisting of a signal line and a ground line. The signal line provides a high-frequency radiation path. The ground line provides a low-frequency radiation path and surrounds a part of the signal line. The signal line has a part thereof exposed to the outside of the ground line. The ground line comprises a ground feed-in point. The signal line comprises a signal feed-in point disposed in a mal-position relative to the ground feed-in point so that a co-planar waveguide structure is formed in the multi-band broadband antenna.

Further, the signal line has a length about ¼ of the wavelength of the high-frequency operating band; the ground line has a length about ¼ of the wavelength of the low-frequency operating band; each wavelength is calculated subject to the center frequency of the respective operating band.

Further, the ground line has a widened trace width in selected areas thereof, forming a non-uniform trace width design.

Further, the signal line comprises a top-loading portion located on one end thereof remote from the signal feed-in point and exposed to the outside of the ground line to increase the high-frequency operating bandwidth.

Other advantages and features of the present invention will be fully understood by reference to the following specification in conjunction with the accompanying drawings, in which like reference signs denote like components of structure.

BRIEF DESCRIPTION OF THE DRAWINGS

FIG. 5 is a radiation efficiency table obtained from the multi-band broadband antenna with mal-position feed structure in accordance with the present invention.

DETAILED DESCRIPTION OF THE PREFERRED EMBODIMENT

Figure 1:
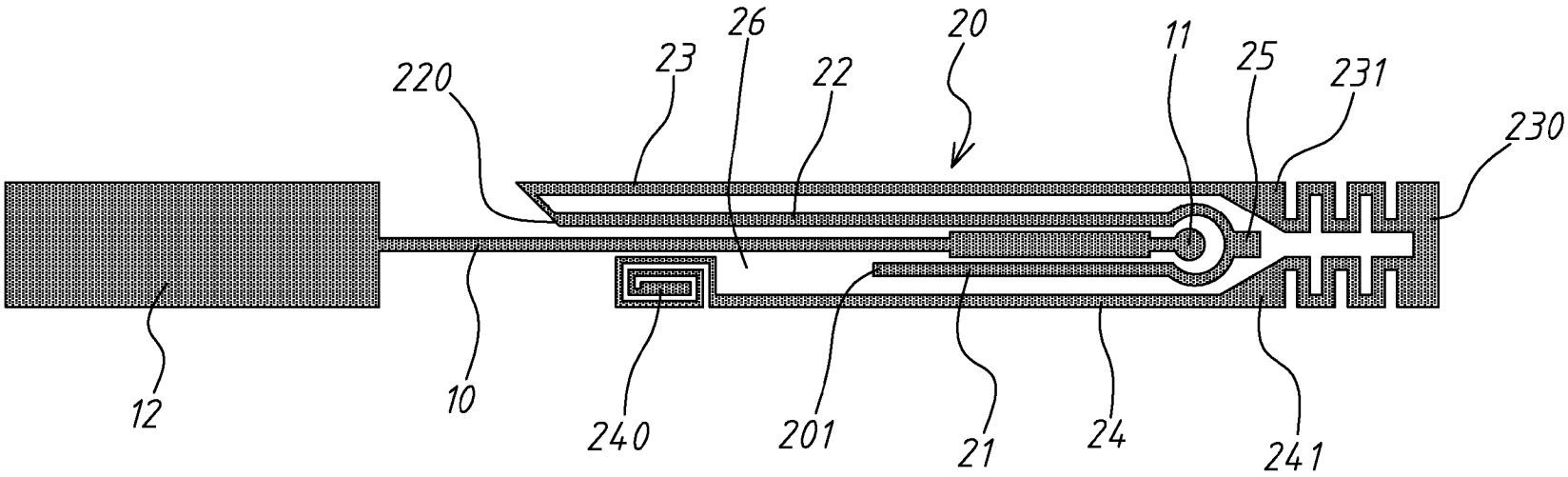
FIG. 1 is a schematic plain view of a multi-band broadband antenna with mal-position feed structure in accordance with the present invention.

Referring to FIG. 1, a multi-band broadband antenna with mal-position feed structure in accordance with the present invention is shown. The multi-band broadband antenna with mal-position feed structure is a dipole structure comprising a signal line 10 and a ground line 20.

The signal line 10 is a high-frequency radiation path, having a length about ¼ of the wavelength (λ) of the high-frequency operating band. The ground line 20 is a low-frequency radiation path, having a length about ¼ of the wavelength (λ) of the low-frequency operating band.

In this embodiment, the aforesaid wavelength (λ) is calculated subject to the center frequency of the respective operating band.

Further, in this embodiment, the ground line 20 surrounds the major part of the length of the signal line 10, and the signal line 10 simply has a predetermined part of the length thereof exposed to the outside of the ground line 20.

Figure 2:
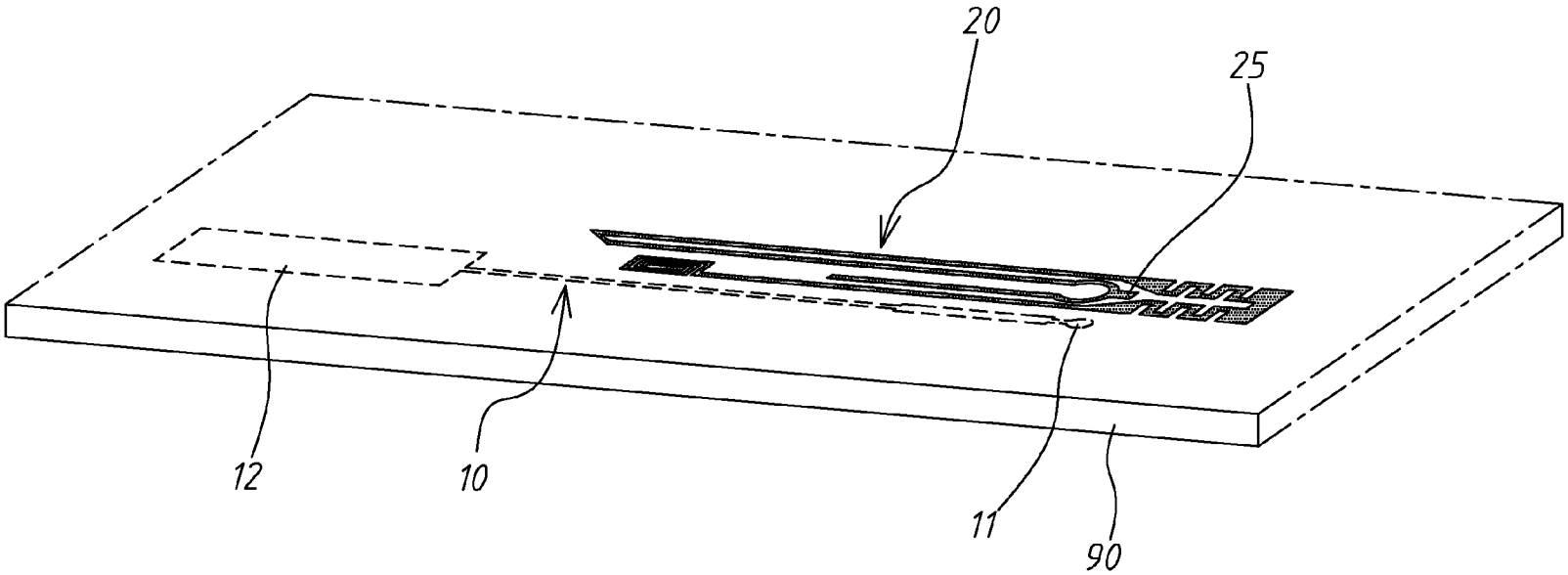
FIG. 2 is a schematic drawing illustrating the multi-band broadband antenna with mal-position feed structure installed in a substrate according to the present invention.

Referring to FIG. 2 and FIG. 1 again, the multi-band broadband antenna with mal-position feed structure is installed in a dielectric substrate 90. As illustrated, the ground line 20 comprises a starting point 201, a relatively shorter straight segment 21 extended from the starting point 201, a relatively longer first reversing segment 22 extended from one end of the straight segment 21 remote from the starting point 201 and terminating in an oblique end portion 220, a second reversing segment 23 reversely extended from the oblique end portion 220 of the first reversing segment 22 and terminating in a curved end portion 230, a third reversing segment 24 reversely extended from the curved end portion 230 of the second reversing segment 23 to let the straight segment 21 and the first reversing segment 22 be surrounded by the second reversing segment 23 and the third reversing segment 24 and terminating in an end scroll 240 in a retracted manner relative to the connection between the oblique end portion 220 of the first reversing segment 22 and the second reversing segment 23, a ground feed-in point 25 located on the connection between the straight segment 21 and the first reversing segment 22, and a middle passage 26 surrounded by the straight segment 21, the first reversing segment 22, the oblique end portion 220 of the first reversing segment 22 and the end scroll 240 of the third reversing segment 24.

Further, the curved end portion 230 of the second reversing segment 23, the oblique end portion 220 of the first reversing segment 22 and the end scroll 240 of the third reversing segment 24, and the part 231 of the second reversing segment 23 and the part 241 of the third reversing segment 24 around the ground feed-in point 25 have a widened trace width, forming a non-uniform trace width design to increase the low-frequency operating bandwidth.

The signal line 10 has the major part thereof disposed in the middle passage 26 of the ground line 20 and surrounded by the straight segment 21, first reversing segment 22 and third reversing segment 24 of the ground line 20. Further, the signal line 10 has a signal feed-in point 11 located on one end thereof and disposed in the middle passage 26 of the ground line 20, and a top-loading portion 12 located on the other end thereof and disposed outside the middle passage 26 of the ground line 20. The design of the top-loading portion 12 increases the high-frequency operating bandwidth.

Figure 3:
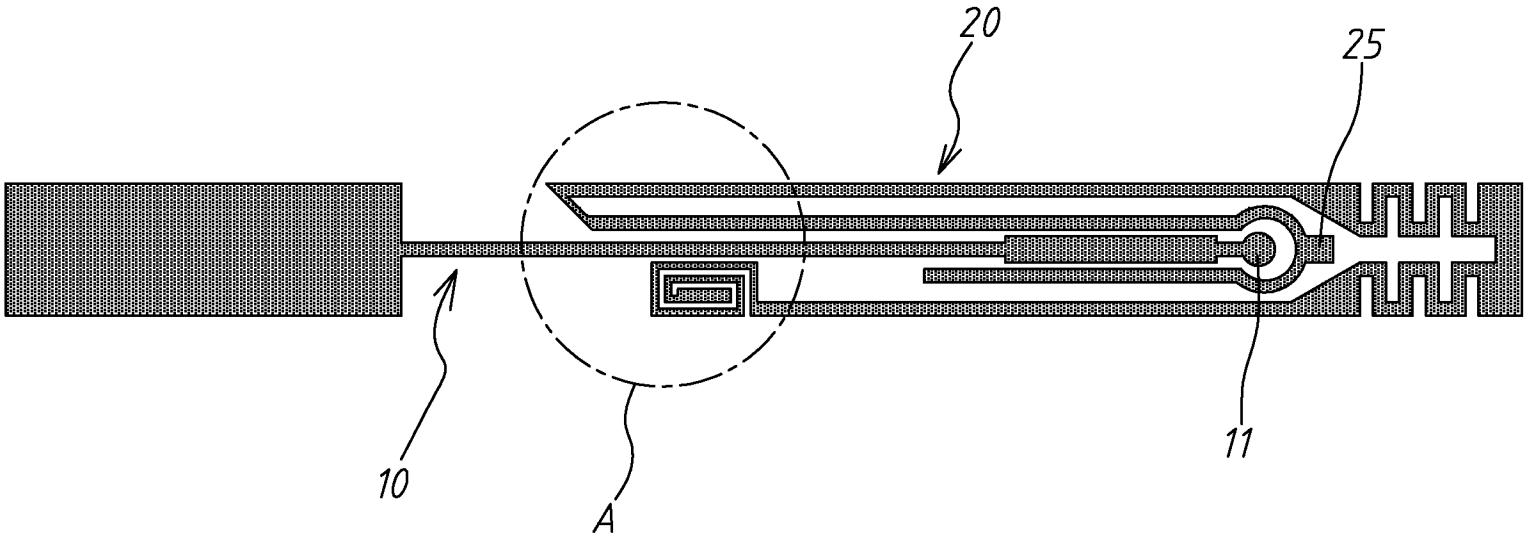
FIG. 3 illustrates a co-planar waveguide of mal-position feed structure formed in the multi-band broadband antenna shown in FIG. 1.

As shown in FIG. 3, as the signal feed-in point 11 and the ground feed-in point 25 exhibit a mal-position feed structure and the ground line 20 surrounds the signal line 10, a co-planar waveguide structure is formed in part A of the multi-band broadband antenna with mal-position feed structure, thereby increasing the operating bandwidth of the antenna.

Figure 4:
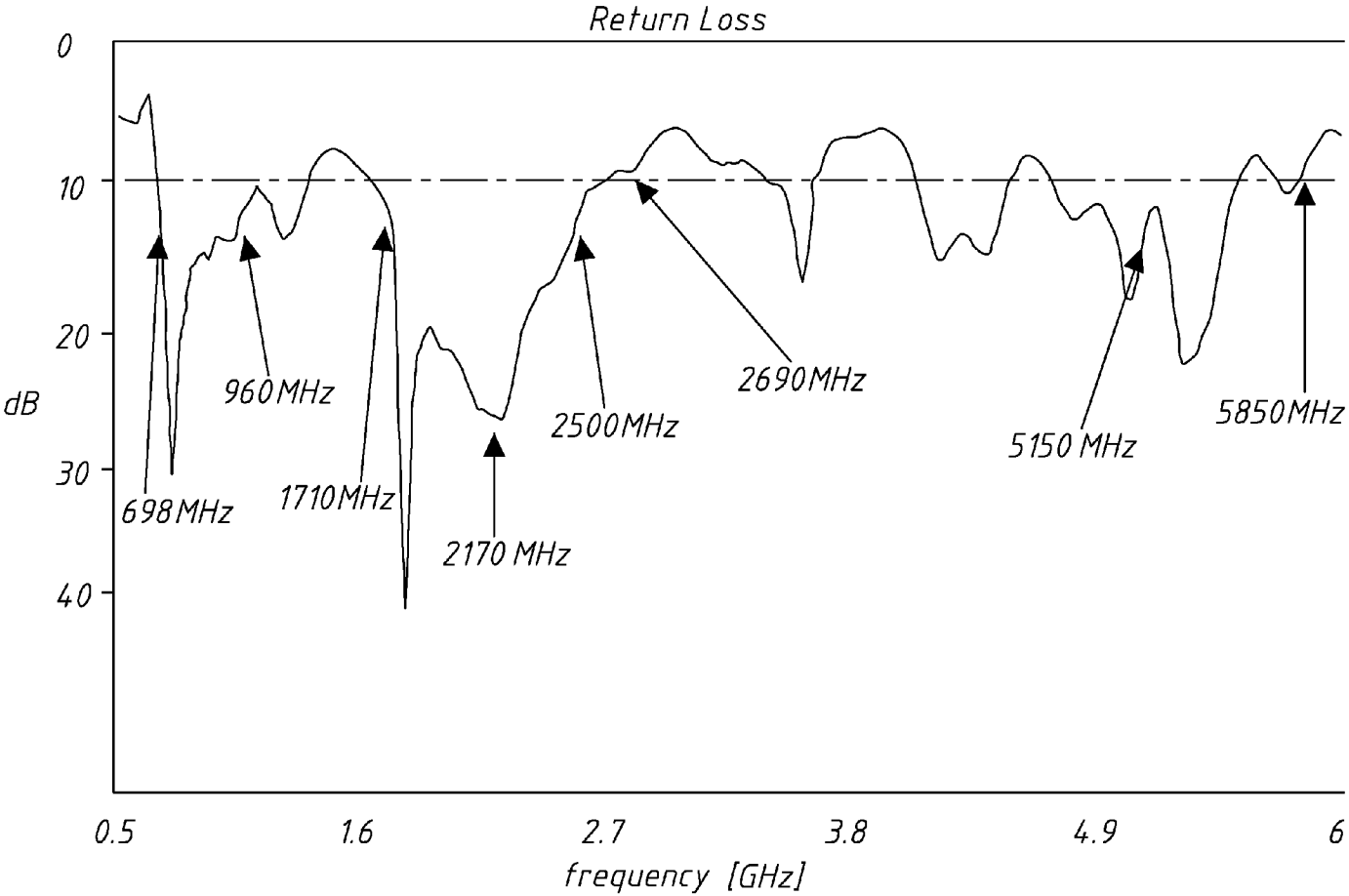
FIG. 4 illustrates a return loss diagram obtained from the multi-band broadband antenna with mal-position feed structure in accordance with the present invention.

FIG. 4 illustrates a return loss diagram obtained from the multi-band broadband antenna with mal-position feed structure in accordance with the present invention. As illustrated, the multi-band broadband antenna with mal-position feed structure shows optimal performance at frequencies 698-960 MHz, 1710-2170 MHz, 2500-2690 MHz and 5150-5850 MHz. With respect to the radiation efficiency of the multi-band broadband antenna with mal-position feed structure, as shown in FIG. 5, the maximum gains are within the range of 0.06-1.08 in H-plane and 0.14-1.99 in E-plane, and the efficiency can reach 50.02%~77.43%. The operating bandwidth is greatly increased.

In conclusion, the invention provides a multi-band broadband antenna consisting of a signal line and a ground line, wherein the signal line is a high-frequency radiation path, providing a signal feed-in point; the ground line is a low-frequency radiation path, providing a ground feed-in point; the signal feed-in point and the ground feed-in point exhibit a mal-position feed structure so that a co-planar waveguide structure is formed in the multi-band broadband antenna to increase the antenna's operating bandwidth.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A multi-band broadband antenna comprising: a dipole structure consisting of a signal line and a ground line, said signal line providing a high-frequency radiation path, said ground line providing a low-frequency radiation path, said ground line surrounding a part of said signal line, said signal line having a part thereof exposed to the outside of said ground line, said ground line comprising a ground feed-in point, said signal line comprising a signal feed-in point disposed in a position relative to said ground feed-in point so that a co-planar waveguide structure is formed in the multi-band broadband antenna;

wherein said ground line comprises a starting point, a straight segment extending from said starting point, a first reversing segment reversely extending with respect to said straight segment from one end of said straight segment remote from said starting point and terminating in an oblique end portion, a second reversing segment reversely extending with respect to said first reversing segment from said oblique end portion of said first reversing segment and terminating in a curved end portion, a third reversing segment reversely extending with respect to said second reversing segment from the curved end portion of said second reversing segment and terminating in an end scroll; the oblique end portion connected between said first reversing segment and said second reversing segment is located on a first end of said ground line, said curved end portion located between said second reversing segment and said third reversing section is located on a second end of said ground line, and said end scroll is located between said first end and said second end of said ground line; a middle passage is surrounded by said straight segment, said first reversing segment, the oblique end portion of said first reversing segment and the end scroll of said third reversing segment; said straight segment has a length that is shorter than a length of said first reversing segment; said straight segment and said first reversing segment are located between said second reversing segment and said third reversing segment; said ground feed-in point is located on the connection between said straight segment and said first reversing segment; and said signal line is located in said middle passage.

2. The multi-band broadband antenna as claimed in claim 1, wherein said ground line has a widened trace width in selected areas thereof, forming a non-uniform trace width design.

3. The multi-band broadband antenna as claimed in claim 1, wherein the curved end portion of said second reversing segment, the oblique end portion of said first reversing segment and the end scroll of said third reversing segment, and a part of said second reversing segment around said ground feed-in point and a part of said third reversing segment around said ground feed-in point have a widened trace width, forming a non-uniform trace width design.

4. The multi-band broadband antenna as claimed in claim 1, wherein said signal line comprises a top-loading portion located on one end thereof remote from said signal feed-in point and exposed to the outside of said ground line.

5. The multi-band broadband antenna as claimed in claim 1, wherein said signal line is disposed in said middle passage and surrounded by said straight segment and said first reversing segment, comprising a top-loading portion located on one end thereof remote from said signal feed-in point and exposed to the outside of said ground line.

6. The multi-band broadband antenna as claimed in claim 1, wherein said ground line has a widened trace width in selected areas thereof, forming a non-uniform trace width design; said signal line comprises a top-loading portion located on one end thereof remote from said signal feed-in point and exposed to the outside of said ground line.

* * * * *